US006637065B2

(12) United States Patent
Biggs

(10) Patent No.: US 6,637,065 B2
(45) Date of Patent: Oct. 28, 2003

(54) QUICK RELEASE MOP HEAD JAWS RETAINER

(76) Inventor: Blyth S. Biggs, 1684 Pine Nut Rd., Gardenerville, NV (US) 89410

( * ) Notice: Subject to any disclaimer, the term of this patent is extended or adjusted under 35 U.S.C. 154(b) by 0 days.

(21) Appl. No.: 09/932,016

(22) Filed: Aug. 16, 2001

(65) Prior Publication Data

US 2003/0037393 A1 Feb. 27, 2003

(51) Int. Cl.[7] ..... A47L 13/24
(52) U.S. Cl. ..... 15/150
(58) Field of Search ..... 15/147.1, 150–153

(56) References Cited

U.S. PATENT DOCUMENTS 1,474,031 A * 11/1923 Hanke ..... 15/150
4,287,632 A * 9/1981 Hammond ..... 15/150
4,680,826 A * 7/1987 Schunter ..... 15/147.1
5,461,749 A * 10/1995 Ahlberg et al. ..... 15/150 X
5,481,777 A * 1/1996 Nenninger ..... 15/151
5,724,696 A * 3/1998 Di Giammarino ..... 15/150
6,098,235 A * 8/2000 Tomm et al. ..... 15/150

* cited by examiner

*Primary Examiner*—Mark Spisich
(74) *Attorney, Agent, or Firm*—Herbert C. Schulze

(57) ABSTRACT

This invention is a quick release mop head of the jaws type. The invention has two significant advances in the art. The most important advance is the provision of an elastic closure which consists of a cord of elastic material secured to one of two hanged jaws at one end. The second end of the cord has an enlarged portion with a handle which slips into a socket on the other jaw for closure allowing enough flexing to prevent breaking the jaws under difficult conditions. This also allows for easy changing of the mop. Additionally I have provided a magnetic closure for simplified interim changing of the mop.

1 Claim, 1 Drawing Sheet

QUICK RELEASE MOP HEAD JAWS RETAINER

CROSS REFERENCE TO RELATED APPLICATIONS

This Application is not related to any pending application filed by me.

BACKGROUND OF THE INVENTION

I. Field of the Invention

This invention is in the general field of mops used in janitorial services;

The invention is more particularly in the field of jaws type retaining and clamping devices for yarn type mop heads;

The invention is even most particularly in the field of improved, quick release jaws mop head clamping devices.

II. Description of the Prior Art

There has been much prior art in the fields of jaws-type retaining and clamping devices for attaching yarn type mop heads to mop handles. I am aware of U.S. Pat. No. 6,098,235, which in itself recites prior art in this field. I am aware of the prior art.

Extensive as the prior art in this general field has been, I am unaware of any prior art as to the quick release method and means I have invented. My invention is an elastic ball and ball retainer arrangement which is easily operable by anyone and which requires no tools, special skills, or the like.

Additionally, my invention is designed for sufficient elasticity to provide a safety cushion for preventing breakage of the clamping jaws mechanism under inadvertent undo stress.

I do not know of any prior art which teaches, nor suggests, my present quick release mop head jaws retainer.

SUMMARY OF THE INVENTION

The device shown and described in U.S. Pat. No. 6,098,235 is an excellent piece of equipment, works well, and was a significant advance in the type of mop head jaws utilizing an upper jaw connected to a mop handle and a lower jaw pivotally connected to the upper jaw. However, for some persons it is somewhat difficult to use due to the force required to engage the latching arrangement, and the tendency of mop material to lodge in the latching arrangement. Additionally, under certain stressing while mopping the latch can become disengaged.

I have been interested in mops and mopping for some time. One of the things I have worked on is the jaws type mop head where the two jaws pivot upon one another. The latching, or closing in position on a mop has been of prime concern. All of the devices of this nature of which I am aware have deficiencies of reliability of securing of the mop, particularly under many of the stresses of mopping which result in biased forces upon the jaws. The rigidity of the connection between the jaws causes problems, including breakage. Also, the necessity to accommodate mops of varying thickness results in less than most effective holding of the mop.

I have now solved the deficiencies of the prior devices by utilizing an elastic closure device which is easily fastened and unfastened by a single individual. The elastic closure uses a reliable ball and socket arrangement in order to insure against breakage or unintentional opening of the jaws while at the same time allowing for sufficient elasticity.

It is an object of this invention to provide a superior jaws type mop head;

It is another object of this invention to provide a jaws type mop head which has an elastic closure;

Another object of this invention is to provide a closure for a jaws type mop head which will accommodate different size mops.

The foregoing and other objects and advantages of this invention will become apparent to those skilled in the art upon reading the description of a preferred embodiment, which follows, in conjunction with a review of the appended drawings.

DESCRIPTION OF A PREFERRED EMBODIMENT

Figure 1:
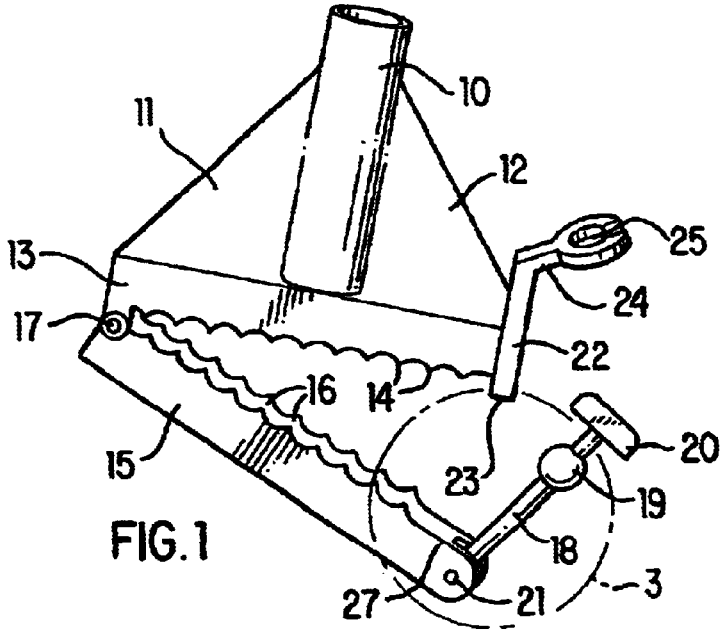
FIG. 1 is a schematic elevational/perspective view of a device, open and with no mop in place, suitable to practice the method of this invention.
Figure 2:
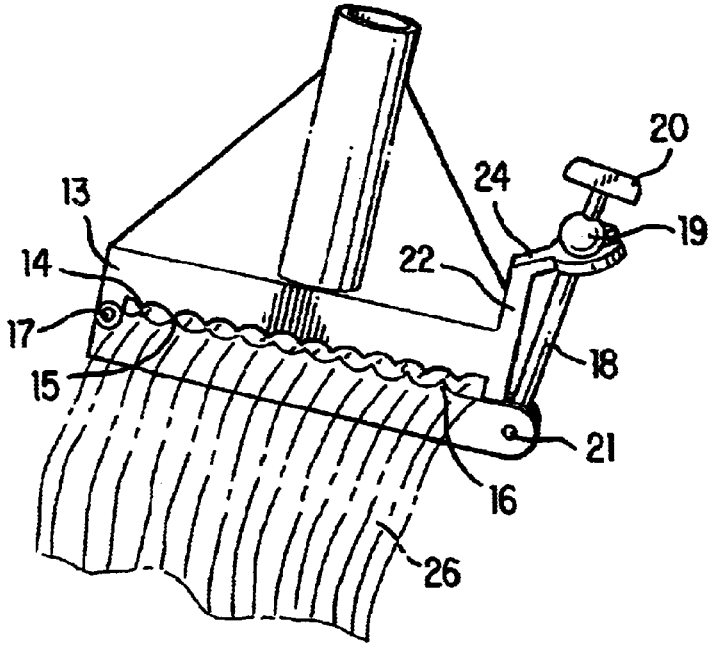
FIG. 2 is a view of the device of FIG. 1 but with device closed and a mop being held in the jaws of the device.

An inventory of items in the drawings with reference numerals is:

| Numeral | Item |
|---|---|
| 10 | tube for insertion of mop handle |
| 11 | support web |
| 12 | support web |
| 13 | upper jaw |
| 14 | teeth |
| 15 | lower jaw |
| 16 | teeth |
| 17 | pivot connection of upper & lower jaw |
| 18 | elastic cord |
| 19 | enlarged end on cord |
| 20 | handle on enlarged end |
| 21 | pivot connection of cord to lower jaw |
| 22 | support and jaw stop |
| 23 | jaw stop end |
| 24 | cord socket arm |
| 25 | cord socket |
| 26 | mop |
| 27 | lower jaw stop position |
| 103 | encircled area 3 on FIG. 1 as it would appear modified by magnetic means |
| 115 | lower jar modified |
| 118 | elastic cord |
| 121 | pivot connection of cord to lower jaw |
| 122 | support and jaw stop |
| 123 | magnet |
| 127 | magnet or magnetically attractable material |

The mop head of this invention consists of a tube or the like 10 to connect to a mop handle with suitable body webs or the like 11 and 12 to provide strength and stability to the connected upper jaw 13. Several protrusions, or teeth, 14 are provided to hold the mop as will be understood by those skilled in the art. The lower jaw 15 which has teeth 16 is pivotally connected at 17 to upper jaw 13.

A rubber, or other elastic cord, 18 having an enlarged portion 19 is pivotally connected at 21 to lower jaw 15. The enlarged portion 19 is preferably, but not necessarily, in the shape of a ball. A handle 20 is formed integrally with, or attached to, the enlarged portion 19. Arm 24 is integrally formed with support and jaw stop member 22. Arm 24 has a horseshoe shaped open end 25 as shown. The opening is formed so as to allow the cord to enter and to cradle and hold the enlarged portion 19 in place when under tension. The handle 20 is suitable to slide between the fingers to be pulled into position under tension when the lower jaw stop position 27 buts against jaw stop end 23.

Figure 3:
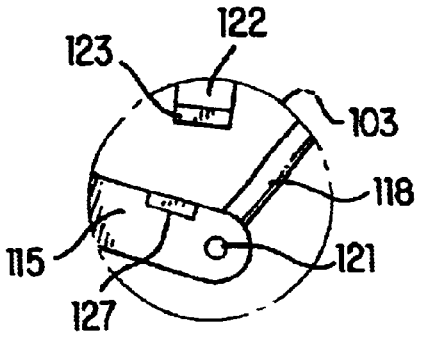
FIG. 3 is the area in the dotted circle 3 as it will appear with my magnetic holding embodiment.

As shown in FIG. 3, in one form of this invention I use a special magnetic interim holding arrangement. What is shown is how the device would look with the magnetic holding arrangement. All of the parts would be exactly the same with the same reference numerals except the numerals would all be in the one hundred series. I have only shown the limited portion of the alternate embodiment as that will be understood by those skilled in the art. I fasten a magnet 123 to the end of support stop 122. and another magnet, or piece of magnetically attractable material 127 on the lower jaw. This gives a substantial advantage in fastening the jaws on the mop. The mop can be placed exactly as desired and easily held that way until the magnetic action holds the jaws together. Then, the jaws can easily be locked while no attention to keeping the mop in the proper position is required. This is true whether using my elastic cord for the final locking in position for mopping or by using the latching system of U.S. Pat. No. 6,098,235 or any other latching system of which I am aware. It is believed that this feature is also completely unique, novel, and useful.

Prior to actual use the mop head will be opened as shown in FIG. 1. The mop 26 will then be placed between the opened jaws. If my magnetic system is used, the jaws will be closed and held closed. Thereafter, my elastic cord will be pulled tight and into the holding socket. The mop is then ready for any use.

While the embodiments of this invention shown and described are fully capable of achieving the objects and advantages desired, it is to be understood that such embodiments are shown for purposes of illustration only and not for purposes of limitation.

I claim:

1. A mop head comprising: a first substantially rigid elongated bar having opposite first and second ends, said bar defining an upper clamping jaw, said upper jaw adapted to be connected to a mop handle; a second substantially rigid elongated bar having opposite first and second ends, said second bar defining a lower clamping jaw; means for pivotally connecting the respective first ends of the first and second bars; and an elastic cord having a first end attached to and extending from the second end of the second bar and an opposite second end, the second end of the elastic cord being adapted to releasably engage a retaining means on the mop head adjacent the second end of the first bar, whereby a mop material may be clamped between the first and second bars when the bars are substantially parallel.

* * * * *